United States Patent [19]

Eichenlaub

[11] 4,053,279

[45] Oct. 11, 1977

[54] FUEL-FIRED, RADIANT HEATER

[76] Inventor: John E. Eichenlaub, 5212 Kellogg Ave., Edina, Minn. 55424

[21] Appl. No.: 660,134

[22] Filed: Feb. 23, 1976

[51] Int. Cl.[2] ..... F27B 17/00; F24C 3/02

[52] U.S. Cl. ..... 432/222; 126/85 R; 126/92 C; 432/185

[58] Field of Search ..... 432/185, 222; 126/85 R, 126/92 C

[56] References Cited

U.S. PATENT DOCUMENTS

| | | | |
|---|---|---|---|
| 3,542,349 | 11/1970 | Ando | 432/185 |
| 3,849,063 | 11/1974 | Eichenlaub | 432/185 |

*Primary Examiner*—John J. Camby
*Attorney, Agent, or Firm*—H. Dale Palmatier

[57] ABSTRACT

A radiant heater is provided with a fuel-fired radiant housed in a combustion chamber having a wall with a radiation-transmissive panel. A plenum adjacent the combustion chamber is provided with air under pressure greater than that in the combustion chamber. Air from the plenum is employed as primary combustion air for the fuel-fired radiant, and air from the plenum also is caused to flow cocurrently into the combustion chamber and to provide adjacent the inner surface of the radiation-transmissive panel a constantly replenished pool or cushion of cool air cooling the panel and providing a buffer layer to prevent impingement of hot combustion product gases thereon. The orientation of the heater within a space to be heated may be varied within limits without adversely affecting its operation, and the heater may be made of small size.

19 Claims, 11 Drawing Figures

FUEL-FIRED, RADIANT HEATER

BACKGROUND OF THE INVENTION

Space heaters having fuel-fired radiant burners have been used for drying and for heating various enclosures; exemplary of such heaters are those shown in my U.S. Pat. Nos. 3,315,656; 3,797,474 and 3,849,063. In the devices of each of these patents I have employed a thin, radiation-transmissive panel to act as a "window" for transmitting infrared radiation into the space to be heated and also for sealing the combustion chamber which houses the radiant from the space being heated. In the devices of two of these patents, a stream of cooling air is permitted to flow, by convection, downwardly over the generally tilted or upright panels to cool the panels. In the last-named patent, a device is described in which a coolant outside the combustion chamber serves to cool the radiation-transmissive panel.

The devices in which cooling air is moved across a panel by convection must be of fairly large size in order to prevent flue products from mixing with external combustion air. In the device of the last-identified patent, the ability of a coolant adjacent the outer, exposed surface of the transparent panel is limited in its cooling effect by the thickness of the panel, by its dependent location and by its generally poor heat conductivity.

There is a definite need for a radiant heater employing a radiation-transmissive panel which is in close proximity with the radiant to reduce the heater size, and which is yet cooled continuously so as to avoid overheating of the panel. There is also a need for such a radiant heater which may assume somewhat different orientations in a space to be heated without interfering with its operation.

SUMMARY OF THE INVENTION

The present invention relates to a fuel-fired, radiant heater which can be manufactured in small sizes, and the orientation of which within an enclosure to be heated may be adjusted as the occasion demands. The heater comprises a fuel-fired radiant, a combustion chamber housing the radiant, and a plenum adjacent the combustion chamber. The combustion chamber includes a lower wall spaced from but confronting the radiant and providing a generally outwardly open radiant port. The port is closed by a thin panel which is highly transmissive of infrared radiation and which has an inner surface confronting the radiant. The combustion chamber includes an outlet port to permit combustion product gases to escape. Means are provided for charging the plenum with air under a pressure greater than that in the combustion chamber. The heater includes means providing an air flow passage from the plenum to the combustion chamber and which is configured to provide a constantly replenished pool of cooling air against the radiation-transmissive panel to cool the same and to prevent impingement on the panel of hot, combustion product gases from the radiant. Means are also provided to convey air cocurrently from the plenum to the radiant for use as as combustion air. The combustion product gases and air from the constantly replenished pool of cooling air may be combined for common discharge from the combustion chamber through the outlet port. The heater may include an auxiliary heat exchanger adjacent the combustion chamber for receiving combustion product gases from the latter chamber and for transmitting the heat thereof into the space to be heated or for other uses.

In a preferred embodiment, the combustion chamber and the plenum share a common wall having a transverse slot-like opening adjacent the lower wall of the combustion chamber and serving to direct air into a pool of cooling air above the inner surface of the radiation-transmissive panel. A common wall between the combustion chamber and the plenum may also mount the radiant in such a manner that the radiant is provided with combustion air from within the plenum. A blower or fan may be employed to provide air under superatmospheric pressure to the plenum, or the blower may be positioned to draw air and combustion product gases from the combustion chamber. In either case, the pressure in the plenum is maintained above the pressure in the combustion chamber to provide the cocurrent flow of combustion air and cooling air.

The invention also provides a heat exchanger of unique construction. The heat exchanger comprises a duct or channel having walls through which extend a plurality of integral vanes. The vanes each protrude inwardly of the duct in the path of a heat exchange fluid such as air, and also extend outwardly of the duct. The inwardly protruding portions of the vanes may define baffles to interrupt the flow of fluid through the duct, and the outwardly extending vane portions provide an expanded heat exchange surface, which may take the form of fins. The integral, unbroken nature of the vanes provide minimum resistance to the conduction of heat by the vanes. The heat exchanger may be fabricated simply by forcing the vanes through the walls of a duct formed of malleable, easily penetrated material such as aluminum sheeting, the holes thus made in the duct walls snuggly sealing against the vanes.

DESCRIPTION OF THE DRAWING

FIG. 1 is an elevational view, in cross section, of a heater of the invention;

DETAILED DESCRIPTION OF THE PREFERRED EMBODIMENT

Figures 2, 5:
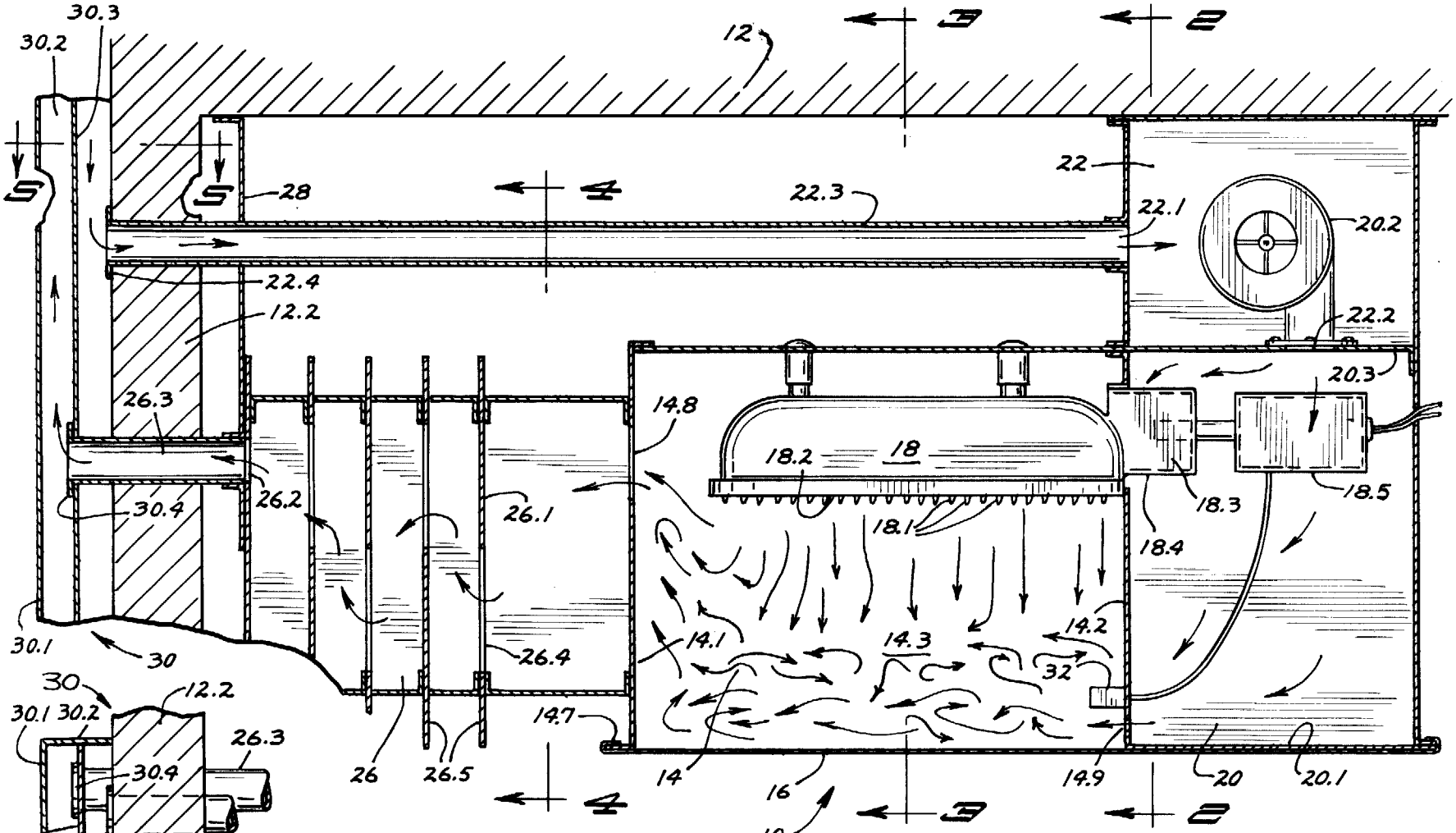
FIG. 2 is a cross-sectional view taken along line 2—2 of FIG. 1.
FIG. 5 is a broken away, cross-sectional view taken along line 5—5 of FIG. 1.
Figure 2:
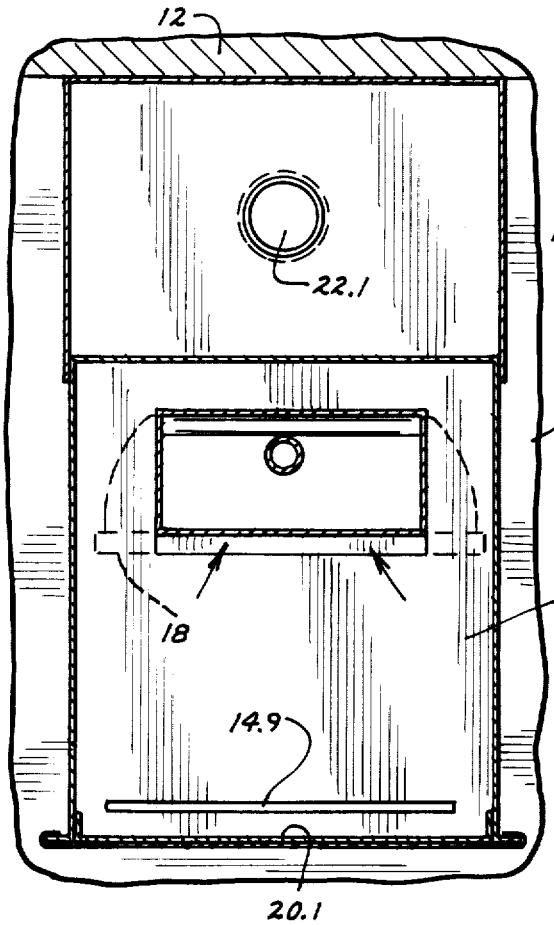
Figure 3:
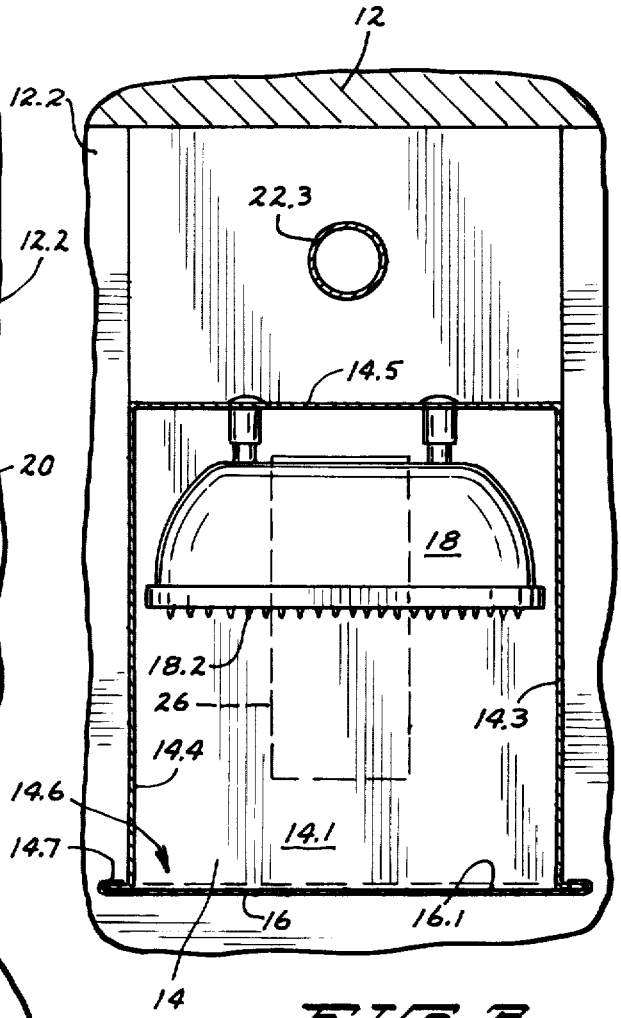
FIG. 3 is a cross-sectional view taken along line 3—3 of FIG. 1.
Figure 4:
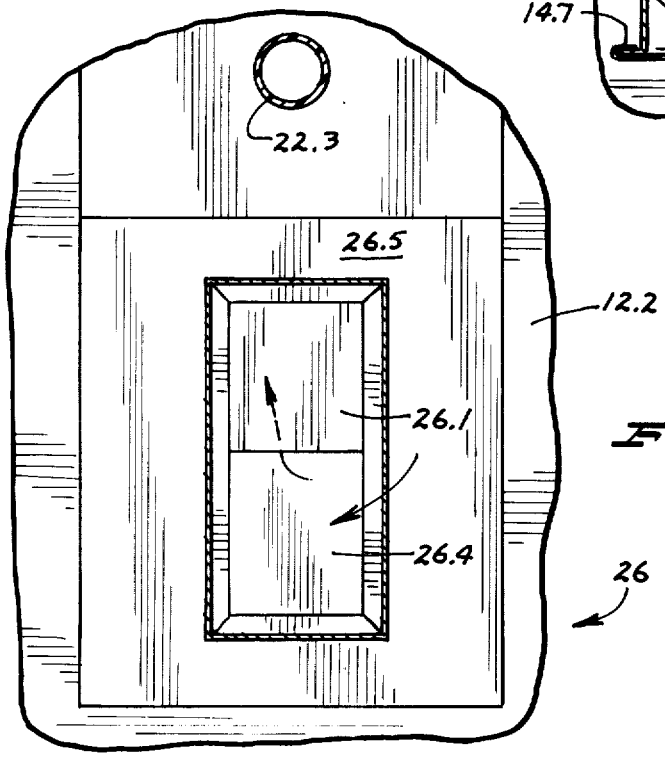
FIG. 4 is a cross-sectional view taken along line 4—4 of FIG. 1.

Referring first to FIG. 1, the heater of the invention is designated generally as 10, and is shown in an exemplary position as being secured to the ceiling 12 of an enclosure to be heated. A generally parallelepiped-shaped combustion chamber 14 is provided with generally upright front and rear walls 14.1, 14.2, and side walls 14.3, 14.4. The chamber includes a top wall 14.5 and a bottom wall 14.6 with a radiation-transmissive port therein. Desirably, the port extends the full distance between the side walls and the front and rear walls, although it may be desirable in some instances to restrict the size of the port to a smaller area. A radiation-transmissive panel 16 is positioned to close the port, and may be fastened by clamps or rivets or the like (not shown) to the periphery of the front, rear and side walls of the combustion chamber. For convenience, the lower ends of the front and side walls may be turned outwardly to form fastening flanges, which are designated generally as 14.7 in the drawing, and to which the thin, radiation-transmissive panel 16 may be affixed.

The radiation-transmissive panel 16 is desirably of a thin, flexible plastic material which ordinarily softens or melts below about 1000° F. Preferred materials for the panel include such thermoplastics as polytetrafluoroethylene (Teflon "TFE", a trademarked product of E. I. DuPont DeNemours and Company, Inc.) which has an infrared transmissivity of approximately 0.88, poly (tetrafluoroethylene-hexafluoropropylene) (Teflon "FEP", manufactured by the DuPont Company), and polyester materials such as poly (ethyleneterephthalate) a product sold under the name Mylar by the DuPont Company and which has an infrared transmissivity of approximately 0.77. Teflon TFE film having a thickness of approximately 0.002 inches is preferred, since this material is flexible, is highly transmissive of infrared radiation, and is more resistant to high temperatures than many other polymeric materials.

Housed within the combustion chamber 14 is a radiant heater such as a gas burner 18, which may be a Schwank-type burner having a downwardly facing radiant face with small holes therein through which gas-air mixtures issue and are burned, the small flames being shown as 18.1 in the drawing. The rearward end of the burner includes a control box 18.3 having on-off, safety and pressure controls and is received within the plenum and is attached to the rear wall 14.2 of the combustion chamber. It will be understood from FIGS. 1 and 2 that the width and length of the radiant are at least half of the width and length of the interior of the combustion chamber, and the radiant is spaced only a short distance above the radiation-transmissive panel 16. The inner surface 16.1 of the latter panel confronts the lower surface 18.2 of the radiant and transmits infrared radiation from the radiant to the space to be heated. Desirably, the radiant surface 18.2 of the burner, and the panel 16, lie in parallel planes.

The combustion chamber is also provided with an exhaust port 14.8 which desirably is located in the front wall 14.1 of the chamber, although the exhaust port may be positioned elsewhere, such as in the top wall, as will be explained. Desirably, the port is positioned near the top of the combustion chamber.

A plenum 20 is provided adjacent, or contiguous the combustion chamber, and the rear wall 14.2 of the combustion chamber is desirably shared with the plenum as shown in FIG. 1. The plenum 20 is generally of a parallelepiped shape, and has a bottom wall 20.1 which may be co-extensive with the radiation-transmissive panel 16 of the combustion chamber. If desired, the radiation-transmissive panel 16 may be continued rearwardly to form the bottom wall 20.1 of the plenum. A blower, illustrated as fan 20.2, is positioned to provide air under pressure to the plenum. The fan may be housed in a blower housing designated generally as 22 in FIG. 1, the housing 22 having an inlet port 22.1 for drawing fresh air into the housing, and an exhaust port 22.2 for exhausting air under pressure into the plenum 20. Although it is preferred to position the blower in the system to provide superatmospheric air to the plenum, the blower may, if desired, be positioned downstream of the exhaust duct 14.8 to draw air and combustion product gases from the combustion chamber. In any event, it will be recognized that the pressure in the plenum 20 is somewhat greater than that in the combustion chamber 14.3. By "plenum" as used herein, reference is made to a compartment continuously furnished with air under pressure greater than that in the combustion chamber. Desirably, the plenum is configured and sized so that the directionality of the air furnished thereto has no substantial directional effect on the streams of air exiting as combustion air and cooling air.

That portion 18.3 of the burner 18 which protrudes into the plenum 20 is provided with openings 18.4 to receive air from the plenum, this air being hereinafter referred to as combustion air which is mixed with fuel vapors. The fuel-air mixture burns at the lower surface 18.2 of the radiant. The protruding end 18.3 of the radiant is provided with a fuel conduit leading to an external source of fuel under pressure.

The common wall 14.2 of the combustion chamber and the plenum is provided adjacent its lower end with a transverse, slot-like opening 14.9, the width of which approaches the full width of the combustion chamber 14. The purpose of the opening 14.9 is to direct cooling air from the plenum into the combustion chamber in the vicinity of the inner surface 16.1 of the radiation-transmissive panel to form a constantly replenished pool of cooling air above the panel to cool the same. If the top and bottom edges of the opening are straight and parallel, as shown in FIG. 2, then the edges may be separated one from the other by a distance of, for example, ⅛ inch. In another embodiment, the opening 14.9 may have one straight edge and one serrated edge, with the points of the serrations approaching or touching the straight edge. It will be understood that many different configurations for the opening 14.9 may suggest themselves to one skilled in the art; for example, the opening 14.9 may comprise a series of holes aligned generally transversely of the wall 14.2, but the configuration for the opening 14.9 should be chosen as to direct air from the plenum to the vicinity of the inner surface of the radiation-transmissive panel so as to provide and maintain a pool of cooling air above and in cooling relationship to the panel.

As shown by the arrows 24 in FIG. 1, the pool of cooling air above the panel 16 within the combustion chamber merges with the combustion product gases from the radiant 18, and the combined gases are exhausted through the port 14.8 of the combustion chamber. As thus described, the plenum 20 provides air both for combustion purposes and for cooling purposes. If the fan 20.2 should fail for some reason, not only will the flow of cooling air cease, but the flow of combustion air will also cease, thereby extinguishing the radiant.

To further make use of the heat of the exhausted combustion product gases, a heat exchanger, designated generally as 26 in FIG. 1, may be positioned downstream from the exhaust port 14.8. As illustrated, the heat exchanger may be generally parallelepiped in shape and may share a common wall, such as front wall 14.1, with the combustion chamber. The heat exchanger has an exhaust port 26.2 which may be provided with appropriate ducts 26.3 to convey the combustion product gases and cooling air through an exterior wall 12.2 and to release the gases to the atmosphere. Interiorly, the heat exchanger 26 may be provided with a series of heat conductive baffles 26.1 which increase the flow path of exhaust gases through the heat exchanger and which aid in the extraction of heat therefrom. The baffles extend integrally through the walls of the heat exchanger to provide exterior fins 26.5 for radiation of heat to the space to be heated. The exterior fins formed by the baffles 26.1 may be separated from one another by a space of approximately one inch. For efficient operation of the heater, the heat exchanger 26 should offer minimum resistance to the passage therethrough of combustion product gases and cooling air. For this reason, the staggered openings 26.4 through the baffled interior of the heat exchanger are fairly large.

In the embodiment depicted in FIG. 1 of the drawing, a bracket 28 extends upwardly from the forward end of the heat exchanger for attachment to the ceiling 12 of an enclosure to be heated, and thus supports the front end of the heater of the invention. The blower housing 22 preferably is positioned above the plenum 20 and is attached to and shares a common wall 20.3 with the plenum. The housing 22 is desirably parallelepiped in shape, and has an upper wall which may be readily attached to the ceiling 12 of the enclosure to be heated, as depicted in FIG. 1. Extending from the outer wall 12.2 of the enclosure to the housing 22 is an intake air duct 22.3 which supplies fresh air from the exterior of the enclosure to the housing 22. Arrangement of the blower housing 22, plenum 20, combustion chamber 14, heat exchanger 26, in this manner permits the heater to be easily and readily installed in an enclosure to be heated adjacent an exterior wall, and causes the combustion chamber 14 to be spaced a safe distance below the ceiling 12. It will also be understood that the ceiling or walls of the enclosure which are adjacent the heater may be provided with appropriate insulation to prevent them from becoming too hot.

Because of the constantly replenished pool of cooling air above the radiation-transmissive panel 16 afforded by the opening 14.9, the size of the heater may be quite small. In one embodiment, for example, the combustion chamber may be on the order of 7 inches wide, 8 inches in height, and 10 inches from front to rear (between the walls 14.1 and 14.2). The width and height of the contiguous plenum 20 may be the same as the combustion chamber, and the plenum may have a length on the order of 6 inches. The blower housing 22 may have the same length and width as the plenum, and may be on the order of 4¾ inches in height. The walls of the housing 22, plenum 20, combustion chamber 24 and heat exchanger may be of sheet aluminum appropriately bent and fastened as in the drawing. Because the heater may be of fairly small size, as explained above, the various parts thereof as depicted may be inexpensively manufactured from a relatively few lengths of sheet metal. For example, the side and top wall of the combustion chamber and the plenum may be provided by a single length of sheet aluminum bent to form an inverted U-shaped trough, as shown perhaps best in FIGS. 1 and 2. A single portion of sheet aluminum may provide the common wall 14.2 between the combustion chamber and the plenum and another length may provide the rearward walls of the plenum 20 and the blower housing 22. The heat exchanger 26, depicted as being generally parallelepiped in shape with baffles 26.1 which pass through the walls of the heat exchanger, will be recognized by those skilled in the sheet metal art as being simple to fabricate.

A high temperature limit switch 32 (FIG. 1), appropriately shielded from radiation, may be positioned within the combustion chamber adjacent the radiation-transmissive panel 16 for the purpose of sensing the temperature adjacent the panel and for shutting off the heater when the temperature reaches or exceeds a given limit, which inevitably will occur if the radiation-transmissive panel is broken. Limit switches of the type described are well known in the art.

The heater of the invention may be vented to the exterior of a building or the like in the manner shown in FIGS. 1 and 2 wherein the intake air duct 22.3 passes outwardly through the wall 12.2 of a building or the like, and is made fast to the building exterior by means of a locking ring 22.4 or the like with the duct 22.3 protruding outwardly from the outer surface of the wall only a very short distance. A flue 30 is provided at the exterior of the wall 12.2 and includes an outer wall 30.1 and side walls 30.2 to form a generally U-shaped structure in cross section as shown in FIG. 5. An upright dividing wall 30.3 divides the flue into inner and outer passages, open at the top and bottom, as shown best in FIGS. 1 and 5, which passages communicate with the atmosphere and serve to supply air to the blower 20.2 and to exhaust combustion product gases, respectively. The inlet air conduit 22.3 thus communicates with the flue passageway between the divider wall 30.3 and the wall 12.2 of the enclosure. The exhaust duct 26.3 extends outwardly through the wall 12.2 and through the divider wall 30.3 to which it is held by means of a locking ring 30.4 so that combustion product gases are exhausted into the flue passageway between the outer wall 30.1 and the divider wall 30.3. When employing the flue 30 as depicted in the drawing, the air inlet and exhaust ducts 22.3 and 26.3 ordinarily will be vertically aligned, although they are shown out of alignment for purpose of clarity in FIG. 5.

In use, fresh air is drawn through the duct 22.3, and is blown by the fan 22.2 into the plenum 20, the latter thus being under a pressure slightly greater than atmospheric. The pressurized air within the plenum enters the radiant through the rearwardly projecting portion of the radiant, and mixes with fuel gas to form a combustible mixture which is burned at the lower surface of the radiant. Concurrently, air under pressure from within the pressure compartment 20 flows through the slot-like opening 14.9 in the common wall 14.2, and forms and continuously replenishes a pool of cooling air on the radiation-transmissive sheet 16. The pool cools the panel, and provides a buffer layer of air which prevents combustion product gases from the radiant from impinging on the panel. The cooling air from the pool mixes with the combustion product gases, and exits through the exhaust port 14.8 into the heat exchanger 26 from which heat is further extracted by the baffles 26.1 and is radiated outwardly by the exterior fins of the heat exchanger. The combustion product gases and mixed cooling air then exit through the exhaust port 26.2 and pass through the flue 30 to the atmosphere. The pressure within the plenum is maintained slightly greater than the pressure within the combustion chamber, and the latter pressure in turn is slightly greater than the pressure in the heat exchanger so that air flow from the plenum to the heat exchanger is maintained.

From FIG. 1, it will be evident that the flows of combustion air and cooling air from the plenum are cocurrent; that is they flow simultaneously from the same source (the plenum) and in generally the same direction (into the combustion chamber). It has been found that although only very small pressure differentials are employed between the plenum and the combustion chamber 14, the constantly replenished pool of cooling air provided above the radiation-transmissive panel 16 is distributed as a layer across the entire panel. Smoke injected into the cooling air to trace its movement has indicated moderate turbulence throughout the pool or layer with marked, that is, increased, turbulence at the interface between the pool and the hot gases driven downwardly from the radiant burner. Combustion product gases from the radiant 18 which are propelled downwardly toward the panel 16 are considerably hotter than the continuously replenished pool of cooling air, and mix with the upper portion of the latter and rise toward the exhaust port before impinging upon and damaging the panel 16. The opening 14.9 through which cooling air is admitted to the combustion chamber is configured to replenish the pool of cooling air at a rate to maintain the pool at a significant pool depth and thus prevent the combustion product gases from the radiant from approaching too closely to the panel 16. In one embodiment, the overall height of the combustion chamber may be on the order of 8 inches, and the downwardly oriented surface 18.2 of the radiant may be spaced only about 5 inches from the panel 16. By judicious adjustment of the cooling air opening 14.9, the combustion product gases issuing from the radiant may be prevented from approaching the panel 16 more closely than, for example, about 2 inches.

As will now be understood, "pool" as used herein refers to a layer of cooling air maintained on the radiation-transmissive panel and which is constantly replenished by the plenum and which is constantly depleted by admixture with combustion product gases for exhaustion from the combustion chamber. The pool of cooling air, in contrast to a rapidly moving air stream, has only a relatively slow gross movement and is maintained at a significant thickness to form a thick cushion or barrier preventing strike-through of combustion product gases to the panel which would occur in the absence of the pool. Since any substantial break in the panel would permit escape of air from the pool of cooling air, thus decreasing its thickness, a safety device (32 in FIG. 1) can be provided to indicate breakage of the panel by sensing temperature changes at a level normally in, or kept relatively cool by, the pool of cooling air when the panel is intact.

Because of the positive flow of air within the combustion chamber which is provided by the pressure compartment 20, the orientation of the heater may be varied somewhat, e.g., by tilting forwardly or rearwardly or from side to side, without undue interference with the operation of the heater. It will be understood that in some instances it may be desired to provide the combustion chamber with a reflective inner surface to reduce the amount of heat absorbed by the combustion chamber walls, or to provide the heater generally with insulated walls.

By supplying air under superatmospheric pressure to the plenum which houses the controls for the radiant, leakage of gaseous fuel or combustion product gases into the plenum is greatly reduced or eliminated. The controls for the heater (which may control the air and gas flow rates, and protective circuitry) may be provided in a control box designated generally as 18.5 in the drawing; access to the controls may be had through a suitable panel in the plenum.

Figure 7:
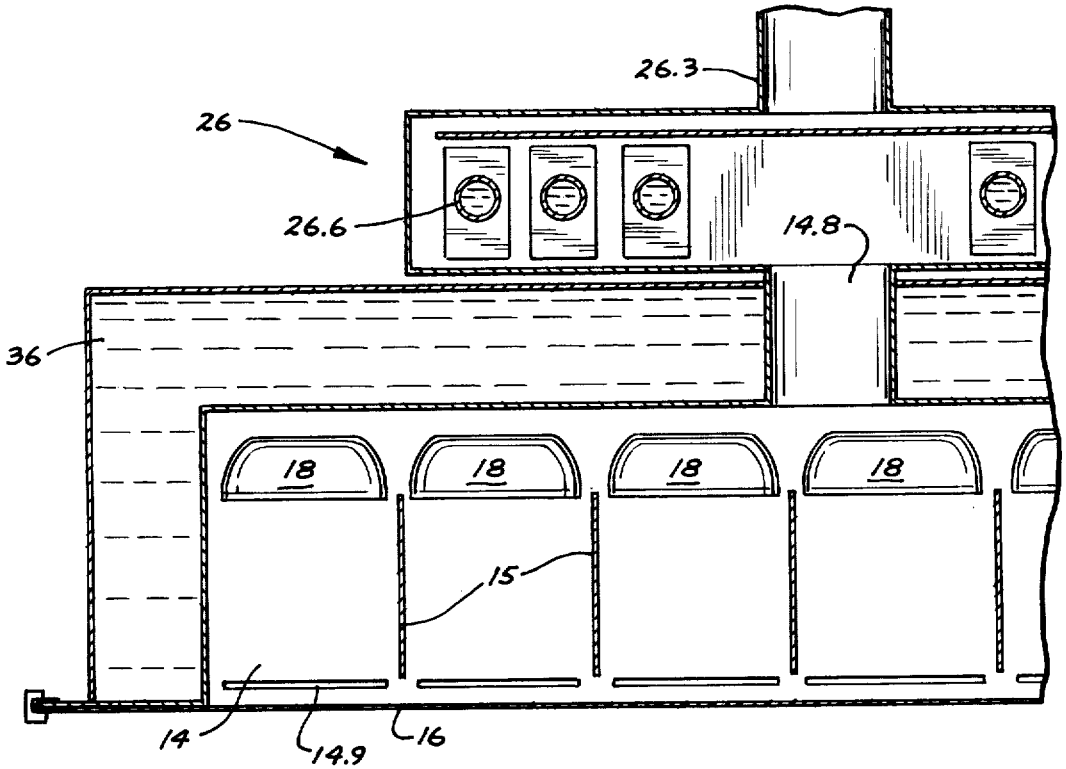
FIG. 7 is a broken away, cross-sectional view taken along line 7—7 of FIG. 6.
Figure 6:
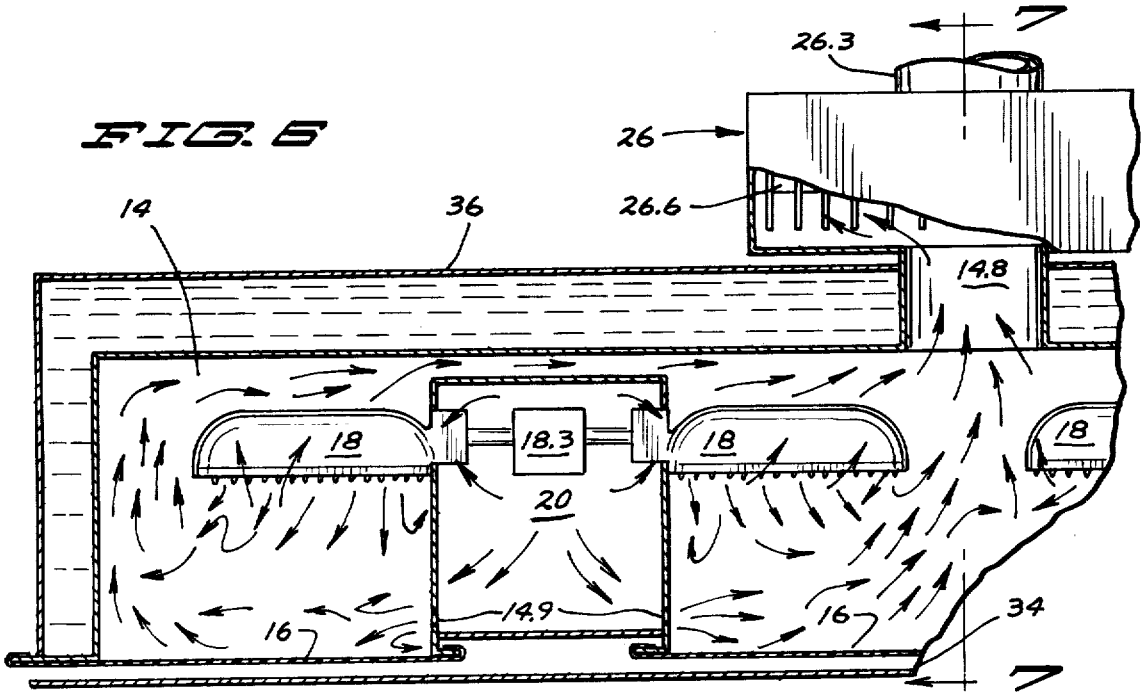
FIG. 6 is a side elevation, shown in cross section and partially broken away, of a drying tunnel or oven employing heaters of the invention.

Schematic representations of a bank or series of heaters of the invention which may be employed in a drying tunnel or oven is shown in largely schematic form in FIGS. 6 and 7, and reference numerals in FIGS. 1 - 5 identify similar parts in FIGS. 6 and 7. A web to be dried by the drying oven is designated as 34 in FIG. 6, and is propelled in the direction shown by arrows. Combustion chambers 14 (FIG. 7) are aligned side by side across the width of the drying tunnel, and may share a common radiation-transmissive panel 16. Cooling air inlet ducts 14.9 are shown for each combustion chamber, although it will be understood that a common opening may extend across the row of combustion chambers. Between every two rows of combustion chambers is positioned a plenum 20 (FIG. 6) which provides combustion air and cooling air in the manner described above to the aligned combustion chambers. Admixed combustion product gases and cooling air from the pool flow to a central upper exhaust duct 14.8 and into a heat exchanger 26. A water jacket, designated 36, forms at least the top wall of the combustion chambers, and preferably the side walls as well, and serves to insulate the surrounding area from the heat eminated from the combustion chambers, and also serves as a source of hot water for auxiliary heating, if desired. The water within the water jacket is circulated through exteriorly finned tubes 26.6 in the heat exchanger, the fins extracting heat from the combustion product gases and transferring the same to the water. If desired, the aligned combustion chambers may together form a single combustion chamber, and reflective divider panels 15 (FIG. 7) may be employed between adjacent burners for the purpose of evenly distributing the flow of radiant heat through the panels.

Figure 8:
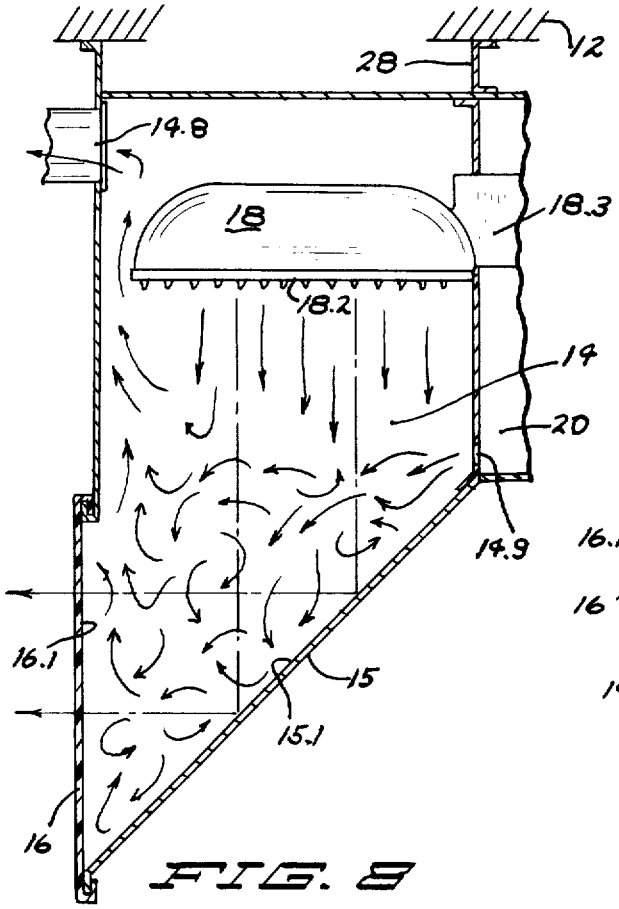
FIGS. 8 and 9 are broken-away side elevations, in partial cross section, of modified forms of the invention.

In the heater embodiment shown in FIG. 8, the lower wall 15 of the combustion chamber 14 slants downwardly beneath the radiant 18 at an angle of, e.g., 45° to the horizontal, and is provided with an infrared radiation-reflective inner surface 15.1. The radiation-transmissive panel 16 is positioned generally vertically and below the level of the radiant, and faces the reflective surface 15.1. Cooling air from the plenum 20 enters the combustion chamber through the port 14.9 and forms a pool of cooling air bounded at its bottom by the slanted wall 15 and at one end by the panel 16. The cooling air flow rate is controlled so that the upper end of the panel 16 remains immersed in the pool of cooling air. The slanted inner reflective surface 15.1 of the wall 15 is also cooled by the pool of cooling air, thereby avoiding gross changes in reflectivity which might occur if the surface 15.1 were to become hot. As previously described with reference to FIG. 1, the hot combustion product gases which impinge from above onto the pool of cooling air are mixed with the cooling air and exit through the exhaust duct 14.8.

Figure 9:
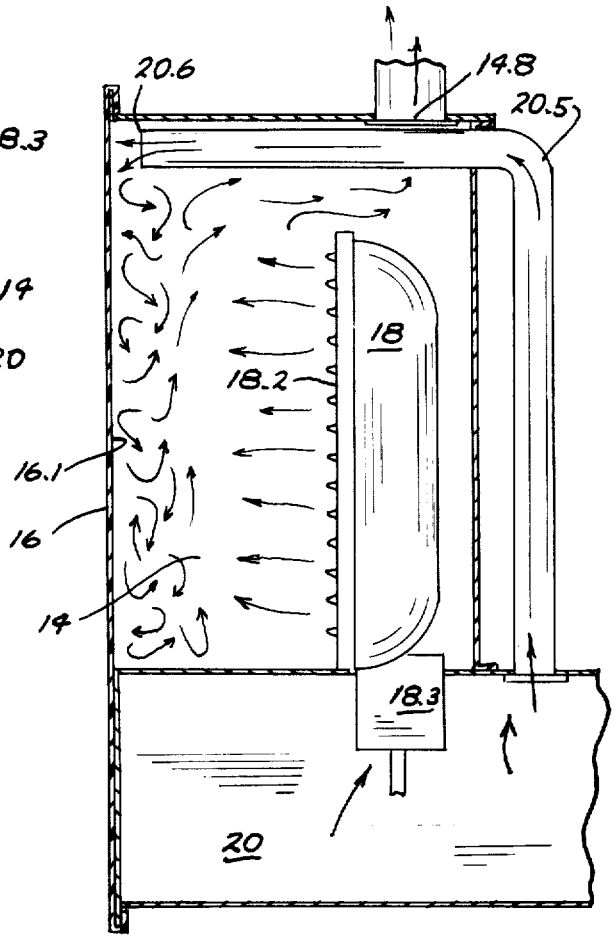

In the heater embodiment of FIG. 9, the radiant 18 is mounted vertically in the combustion chamber facing the generally vertically supported radiation-transmissive panel 16. Cooling air from the plenum 20 flows upwardly through duct 20.5 which turns inwardly of the combustion chamber 14 and has an open end 20.6 adjacent the upper end of the panel 16 to supply cooling air thereto. The cooling air thus supplied forms a thick cushion or barrier layer along the inner surface 16.1 of the panel which prevents strike-through of hot combustion product gases onto the panel. The latter gases, admixed with cooling air, exit through the exhaust port 14.8.

Figure 10:
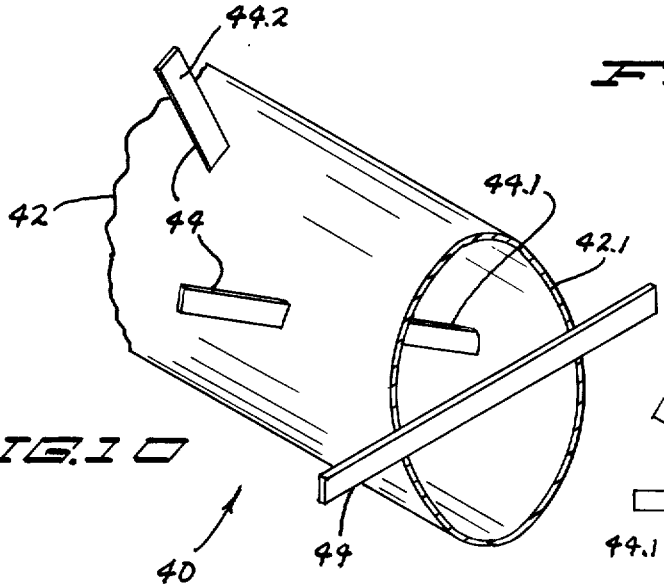
FIG. 10 is a broken away perspective view, in partial cross section, of a heat exchanger useful with the heater of the invention.
Figure 11:
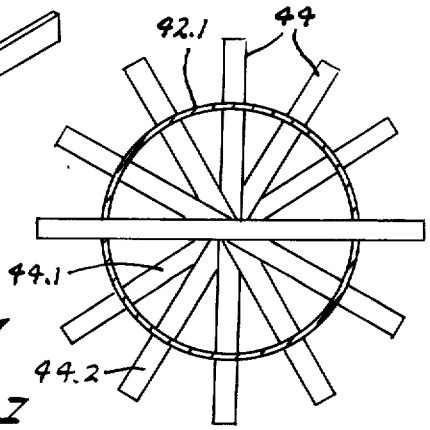
FIG. 11 is an end view, in cross section, of the heat exchanger of FIG. 10.

FIGS. 10 and 11 depict an embodiment of an easily fabricated heat exchanger of general utility and useful with the heaters of the invention. The heat exchanger is designated generally as 40 and includes a tube or duct 42 of any convenient cross-sectional configuration and having piercable walls 42.1. A plurality of spaced, integral, heat conductive, metal vanes 44 extend through the walls of the duct. Each vane has a portion 44.1 protruding inwardly of the duct in the path of a heat transfer fluid to be carried by the duct, and each vane has also a portion 44.2 extending outwardly of the duct. As shown in FIGS. 10 and 11, the vanes 44 may pass entirely through the duct so that both of its ends protrude outwardly thereof, the vanes being thus fully and independently supported in position by opposing duct walls.

The inwardly protruding vane portions 44.1 in the path of a heat transfer fluid may act as baffles to increase the flow path of the fluid without significantly reducing the fluid flow rate. The vanes may be elongated bars of rectangular cross section, and may be twisted within the duct to impart a rotary or cyclonic motion to fluid passing therethrough. Or, the longest cross section dimension of the bars may be parallel to the axis of the duct so that the inwardly protruding portions 44.1 merely expand the interior surface of the duct available for heat transfer. The outwardly extending portions 44.2 of the vanes increase the exterior area of the duct available for heat transfer, and these portions may be generally parallel and aligned to provide fins between which may pass, e.g., air to be heated.

The vanes may be mounted to the duct simply and easily by piercing the duct walls with the vanes and leaving the vanes in place. The duct may be made of an easily pierced material such as thin aluminum sheeting, and the edges of the pierced holes engage and substantially seal against the vanes passing therethrough. The vanes may be of aluminum rod or bar stock somewhat stiffer than the duct, and ends of the bars may be sharpened as desired to facilitate piercing of the duct walls.

Of importance is the feature that the vanes are integral and unbroken as they pass through the duct walls, thereby avoiding resistance to heat conduction due to riveted interfaces.

Thus, manifestly, I have provided a fuel-fired radiant heater which can be inexpensively manufactured and which can be of relatively small size for use within small enclosures, such as in a drying tunnel. The orientation of the heater with respect to the horizontal may be adjusted because of the positive cocurrent flow of combustion and cooling air in the heater. Moreover, air currents in the enclosure to be heated have little if any effect upon the operation of the heater. My radiant heater makes use of a constantly replenished pool of cooling air against a radiation-transmissive panel confronting the radiant burners, the pool forming a barrier-like layer to cool the panel and to prevent impingement thereon of hot combustion product gases from the radiant.

While I have described a preferred embodiment of the present invention, it should be understood that various changes, adaptations, and modifications may be made therein without departing from the spirit of the invention and the scope of the appended claims.

What is claimed is:

1. A fuel-fired, radiant heater comprising a fuel-fired radiant; a combustion chamber housing the radiant and having a lower wall spaced below the radiant and providing a generally downwardly open port closed by a thin panel highly transmissive of infrared radiation and having an inner surface confronting the radiant, the combustion chamber having an outlet port to permit escape of combustion product gases; and air supply means for supplying flows of air to the combustion chamber at a pressure higher than the combustion chamber pressure, the air supply means including means conveying air to the radiant for use as primary combustion air and means providing an air flow passage into the combustion chamber and configured to provide a constantly replenished pool of cooling air above the panel to cool the same and to prevent the impingement thereon of hot combustion product gases from the radiant.

2. A fuel-fired, radiant heater comprising a fuel-fired radiant; a combustion chamber housing the radiant and having a wall providing an outwardly open port closed by a thin panel highly transmissive of infrared radiation from the radiant and spaced therebelow, the combustion chamber having an outlet port to permit escape of combustion product gases; a plenum, means for establishing a continuous pressure differential between the plenum and the combustion chamber with the pressure in the former greater than that in the latter; means providing an air flow passage from the plenum to the combustion chamber and configured to provide, and to continuously replenish, a pool of cooling air against and along the panel to cool the same and to prevent impingement thereon of hot combustion product gases; and means conveying air from the plenum to the radiant for use as combustion air.

3. The heater of claim 2 in which the plenum shares a common wall with the combustion chamber, the wall having an opening therein defining said air flow passage.

4. The heater of claim 2 including a heat exchanger in position to receive hot combustion product gases from the outlet port of the combustion chamber, the heat exchanger having baffles therein to extract heat from the combustion product gases and the baffles protruding through walls of the heat exchanger to define exterior fins integral with the baffles for radiating heat exteriorly of the heater.

5. The heater of claim 2 further comprising a safety shut-off means including a temperature sensor positioned within the combustion chamber and positioned above the panel to sense temperatures at a level normally in the pool of cooling air, whereby any breakage of the panel causing reduction in pool thickness results in an increased temperature sensed by the sensor.

6. The heater of claim 2 in which the means for establishing a pressure differential comprises a powered blower in position to draw air from the atmosphere and to discharge air under superatmospheric pressure into the plenum.

7. The heater of claim 2 in which the combustion chamber, plenum and air flow passage therebetween are so constructed and arranged as to provide a layer of turbulent air defining the pool of air above the panel with the layer extending completely across the panel and having an upper portion of increased turublence where contacted by downwardly flowing combustion product gases from the radiant.

8. The heater of claim 2 in which the means for establishing a pressure differential is a blower positioned to draw combustion product gases and cooling air from the combustion chamber.

9. The heater of claim 2 in which the radiant has dimensions approaching those of the combustion chamber, whereby the heater can be made of small size.

10. The heater of claim 7 in which the combustion chamber, the pressure compartment and the blower housing are each generally parallelepiped in shape and are mutually arranged with a common wall between the combustion chamber and the plenum and another common wall between the plenum and the blower housing.

11. The heater of claim 10 wherein the combustion chamber has an end wall common to it and the pressure compartment, and wherein the pressure compartment has a top wall common to it and the blower housing.

12. The heater of claim 2 wherein the combustion chamber includes a plurality of radiants of which at least two are provided with air from a common plenum.

13. The heater of claim 12 including a cooling water jacket forming at least a top wall of the combustion chamber.

14. A fuel-fired, radiant heater, comprising:

a. a downwardly oriented, fuel-fired radiant;

b. a generally parallelepiped shaped combustion chamber housing the radiant and having top, side, end and bottom walls with the radiant nearer the top wall than the bottom wall, the radiant having generally horizontal dimensions which are at least half the inside horizontal dimensions of the combustion chamber, the lower wall being spaced below the radiant and having a generally downwardly open port closed by a generally horizontal, thin panel highly transmissive of infrared radiation, the panel having an inner surface confronting the radiant and the combustion chamber having an outlet port for exhaustion of combustion product gases;

c. a powered blower to draw cooling air from the atmosphere and to discharge the air under superatmospheric pressure;

d. a generally parallelepiped shaped plenum having a side wall common to it and the combustion chamber, the plenum having an inlet positioned to receive the air under superatmospheric pressure from the blower, the common side wall having an opening therein adjacent the inner surface of the radiation-transmissive panel and configured to direct cooling air into the combustion chamber in the vicinity of the panel to cool the latter, said cooling air settling above the panel in a thick, turbulent, constantly replenished barrier layer in contact with and preventing impingement of hot combustion product gases on the panel, the radiant including an air inlet protruding into the plenum to receive combustion air therefrom in cocurrent flow with the cooling air.

15. A fuel-fired, radiant heater, comprising a plenum, and means for continuously supplying the plenum with air under superatmospheric pressure;

a plurality of generally downwardly oriented, fuel-fired radiants, and means supplying air for use as combustion air from the plenum to each of the radiants;

a combustion chamber housing the radiants and having a lower wall providing a generally downwardly open port closed by a thin panel highly transmissive of infrared radiation and having an inner surface confronting the downwardly oriented radiants; the combustion chamber having an outlet port for discharge of combustion product gases therefrom, and the combustion chamber further having a wall in common with the plenum, the common wall having an air flow duct therethrough and configured to provide a constantly replenished pool of cooling air above the panel to cool the same and to prevent impingement thereon of hot combustion product gases.

16. The heater of claim 15 including a heat exchanger in flow communication with the combustion chamber to receive hot combustion product gases therefrom and to radiate heat exteriorly of the heat exchanger.

17. The heater of claim 16 including a water jacket defining at least a top wall of the combustion chamber.

18. The heater of claim 2 wherein the combustion chamber has a downwardly slanted bottom wall having a reflective inner surface oriented to reflect radiation from the radiant in a generally horizontal direction, and wherein said panel is provided in a side wall of the combustion chamber and is oriented to transmit outwardly radiation reflected by said reflective surface.

19. The heater of claim 1 wherein the radiant has a generally vertical radiant surface and wherein the radiation-transmissive panel is provided in a side wall of the combustion chamber confronting the radiant surface, said air flow passage from the plenum extending adjacent the inner surface of the panel at its top to supply a cushion of cooling air against and along the panel.

* * * * *